US005211340A

United States Patent [19]

Yoshizu

[11] Patent Number: 5,211,340

[45] Date of Patent: May 18, 1993

[54] FUEL INJECTOR

[75] Inventor: Fumitsugu Yoshizu, Saitama, Japan

[73] Assignee: Zexel Corporation, Tokyo, Japan

[21] Appl. No.: 925,271

[22] Filed: Aug. 6, 1992

[30] Foreign Application Priority Data

Aug. 27, 1991 [JP] Japan ..... 3-75209[U]
Aug. 27, 1991 [JP] Japan ..... 3-75210[U]

[51] Int. Cl.[5] ..... F02M 45/08

[52] U.S. Cl. ..... 239/533.4; 239/443; 239/533.9

[58] Field of Search ..... 239/533.4, 533.3, 533.5, 239/533.6, 533.8, 533.9, 533.12, 436, 443

[56] References Cited

U.S. PATENT DOCUMENTS

| | | | |
|---|---|---|---|
| 4,403,740 | 9/1983 | Eblen et al. | 239/533.4 |
| 4,448,356 | 5/1984 | Nakajima et al. | 239/533.9 |
| 4,768,719 | 9/1988 | Straubel et al. | 239/533.9 |
| 4,826,086 | 5/1989 | Ogawa et al. | 239/533.5 |

FOREIGN PATENT DOCUMENTS

| | | | |
|---|---|---|---|
| 2434339 | 1/1975 | Fed. Rep. of Germany | 239/533.4 |
| 2711350 | 9/1978 | Fed. Rep. of Germany | 239/533.9 |
| 56-129568 | 10/1981 | Japan . | |
| 57-158972 | 10/1982 | Japan . | |
| 62-87171 | 6/1987 | Japan . | |
| 0094073 | 4/1988 | Japan | 239/533.5 |
| 1-92569 | 4/1989 | Japan . | |
| 1-158553 | 11/1989 | Japan . | |
| 0926345 | 5/1980 | U.S.S.R. | 239/533.3 |
| 2223270 | 4/1990 | United Kingdom | 239/533.4 |

OTHER PUBLICATIONS

Tanasawa et al., *Technology Reports of Tohoku University*, vol. 22, No. 2, pp. 157–164, issued Mar. 25, 1958; Editor: Engineering Department of Tohoku University; Publisher: Tohoku University.

*Primary Examiner*—Andres Kashnikow
*Assistant Examiner*—Christopher G. Trainor

[57] ABSTRACT

In a fuel injector, a plurality of pairs of first and second injection ports are formed in a distal end portion of a nozzle body, and are spaced from one another peripherally of the nozzle body. The angles of the first and second injection ports relative to an axis of the nozzle body is different from each other. The inner ends of the first injection ports are disposed at a valve seat, and the inner ends of the second injection ports are spaced from the inner ends of the first injection ports toward the distal end of the nozzle body in the axial direction of the nozzle body. Each pair of first and second injection ports have a substantially common outer end. At an initial stage of the lift of the needle valve, the injection of fuel from the first injection ports is effected preferentially due to a throttle effect between the abutment portion and the valve seat. When the amount of lift of the needle valve exceeds a specified lift amount, the injection of fuel from the second injection ports is effected preferentially. The speed of lift of the needle valve is limited by a lift speed limiting mechanism until the amount of lift of the needle valve reaches the specified lift amount, thereby prolonging the time period of the fuel injection from the first injection ports.

11 Claims, 6 Drawing Sheets

FUEL INJECTOR

BACKGROUND OF THE INVENTION

This invention relates to a fuel injector for injecting fuel, fed under pressure from a fuel injection pump, into a combustion chamber of an engine.

A fuel injector disclosed in Japanese Laid-Open Patent Application No. 1-92569 comprises an elongate hollow nozzle body having a closed lower end, and a needle valve mounted within the nozzle body. This nozzle body includes a fuel reservoir chamber, a tapered valve seat formed on the inner surface of the lower end portion of the nozzle body, and a pair of injection ports (that is, first and second injection ports) formed in the lower end portion of the nozzle body. The angle of the first injection port with respect to the axis of the nozzle body is acute whereas the angle of the second injection port with respect to the axis of the nozzle body is generally 90°. The inner ends of the first and second injection ports are disposed at the valve seat of the nozzle body, and are disposed at the same position in the direction of the axis of the nozzle body. The outer ends of the first and second injection ports are spaced apart from each other. On the other hand, the needle valve has a pressure receiving portion exposed to the fuel reservoir chamber, and a tapered conical abutment portion formed at its lower end portion. The needle valve is urged by a spring, so that its abutment portion is seated on the valve seat. In this seated condition, the inner ends of the first and second injection ports are closed by the outer peripheral surface of the abutment portion. The pressure of fuel fed into the fuel reservoir chamber from a fuel injection pump acts on the pressure receiving portion to cause the needle valve to lift against the bias of the spring, so that the abutment portion is brought out of contact with the valve seat. As a result, the first and second injection ports are opened to inject the fuel into a combustion chamber of an engine.

The fuel injector of the above patent publication is mounted on the engine in inclined relation to the axis of an engine cylinder, and therefore it is expected that the first and second injection ports are inclined at generally the same angle relative to the axis of the engine cylinder. In this case, the fuel is injected simultaneously from the first and second injection ports at the same inclination angle relative to the axis of the engine cylinder. Therefore, the fuel can not be injected into the combustion chamber over a wide range.

Let's assume that the above fuel injector is mounted in parallel relation to the axis of the engine cylinder. When the needle valve is lifted, the fuel is injected simultaneously from the first and second injection ports at difference angles relative to the axis of the engine cylinder. In this case, the distribution of the fuel in the combustion chamber is extremely uneven.

In the fuel injector of the above patent publication, since the outer ends of the first and second injection ports are spaced apart from each other, the effect of making the fuel particles fine as achieved in the present invention can not be expected.

Japanese Laid-Open Utility Model Application No. 62-87171 discloses a fuel injector comprising a nozzle body and a needle valve. The nozzle body has a tapered valve seat formed at a lower end portion thereof, and a small chamber provided below this valve seat. A single first injection port and a plurality of second injection ports are formed in the lower end portion of the nozzle body, and the angle of inclination of the first injection port is different from that of the second injection ports. When the fuel injector is slightly obliquely mounted on an engine, the first injection port extends generally horizontally, and the second injection ports extend obliquely downward. The inner end of the first injection port is open to the valve seat, and the inner ends of the second injection ports are open to the inner peripheral surface of the small chamber. The needle valve has at its lower end portion a tapered conical abutment portion and a throttle portion formed at the lower end of this abutment portion. When the abutment portion is seated on the valve seat, the throttle portion is extended into the above small chamber. In this seated condition, the inner end of the first injection port is closed by the outer peripheral surface of the abutment portion, and the inner ends of the second injection ports are closed by the outer peripheral surface of the throttle portion. When the needle valve lifts, the abutment portion is brought out of contact with the valve seat at an initial stage at which the amount of lift is small, so that the first injection port is opened, thereby injecting the fuel from the first injection port toward an ignition plug. At this initial stage, the throttle portion remains received in the small chamber, and therefore the second injection ports are kept closed. When the needle valve further lifts, the throttle portion comes out of the small chamber, so that the second injection ports are opened, thereby injecting the fuel from the second injection ports.

In the fuel injector of the above Japanese Laid-Open Utility Model Application No. 62-87171, the fuel is injected from the first injection port only toward the ignition plug when the amount of lift of the needle valve is small, and therefore the fuel can not be supplied into the combustion chamber over a wide range. Further, since the outer ends of all the injection ports are spaced apart from one another, the fuel particles can not be made fine.

Japanese Laid-Open Utility Model Application No. 57-158972 discloses a fuel injector similar to the fuel injector of the above Japanese Laid-Open Utility Model Application No. 62-87171. This fuel injector has first and second injection ports which are inclined at the same angle. When the lift of a needle valve is small, fuel is injected from the first injection port, and when the lift is large, the fuel is injected from the first and second injection ports. In this fuel injector, the direction of the fuel injection is not changed regardless of the amount of lift of the needle valve, and therefore, the fuel can not be supplied into the combustion chamber over a wide range. Further, since the outer ends of all the injection ports are spaced apart from one another, the fuel can not be made fine.

Technology Reports of Tohoku University (Vol. 22, No. 2, pages 157 to 164, issued Mar. 25, 1958; Editor: Engineering Department of Tohoku University; Publisher: Tohoku University) discloses a fuel injector comprising a nozzle body and a needle valve. The nozzle body has an equalizer chamber at its lower end portion, and a valve seat provided above this equalizer chamber. A plurality of pairs of first and second injection ports are formed in the lower portion of the nozzle body, and are spaced circumferentially of the nozzle body. The first injection ports extend obliquely downward relative to the axis of the nozzle body, and the second injection ports extend perpendicularly to the axis of the nozzle body. The inner ends of the first injection ports are disposed above the inner ends of the second injection ports. The inner ends of the first and second injection ports are open to the equalizer chamber. Each pair of first and second injection ports have a common outer end. In this fuel injector, since the inner ends of the first and second injection ports are open to the equalizer chamber, the fuel is injected from the first and second injection ports when the needle valve lifts, so that the fuel can be injected at a wide angle. However, the pressures at the inner ends of the first and second injection ports are equal to each other, and the fuel is injected simultaneously from the first and second injection ports, and therefore the direction of injection of the fuel can be not selected in accordance with the amount of lift of the needle valve. Further, since no pressure difference occurs at the common outer end of the first and second injection ports, a cavitation is not produced, and it can not be expected to make the fuel particles fine.

Japanese Laid-Open Utility Model Application Nos. 56-129568 and 1-158553 respectively disclose lift control mechanisms similar in basic construction to lift control mechanisms used in two embodiments of the present invention.

The inventor of the present invention earlier filed a U.S. patent application Ser. No. 07/803,587 on Dec. 9, 1991 directed to a fuel injector similar to the fuel injector of the present invention, and its German counterpart is P4142430.1 filed on Dec. 20, 1991.

SUMMARY OF THE INVENTION

It is an object of this invention to provide a fuel injector in which the direction of injection of fuel is changed in accordance with the amount of lift of a needle valve, and also an initial fuel injection direction is maintained for a sufficient time period, thereby supplying the fuel to an internal space of an engine cylinder over a wide range, and further the fuel particles to be injected can be made fine, thereby enhancing a combustion efficiency.

According to the present invention, there is provided a fuel injector comprising:

(a) a hollow elongate nozzle body having a closed distal end, the nozzle body having a guide hole, a fuel reservoir chamber provided forwardly of the guide hole, a tapered valve seat formed on an inner surface of the distal end portion of the nozzle body, and a plurality of pairs of first and second injection ports formed in the distal end portion of the nozzle body and spaced from one another in a direction of the periphery of the nozzle body, the angle of the first injection port relative to an axis of the nozzle body being different from the angle of the second injection port relative to the axis of the nozzle body, inner ends of the first injection ports being disposed at the valve seat, inner ends of the second injection ports being spaced from the inner ends of the first injection ports toward the distal end of the nozzle body in the direction of the axis of the nozzle body, and each pair of the first and second injection ports having a substantially common outer end;

(b) a needle valve received in the nozzle body, the needle valve having a slide portion slidably received in the guide hole, a pressure receiving portion received in the fuel reservoir chamber, and a tapered conical abutment portion formed at a distal end portion of the needle valve, and the inner ends of the first injection ports facing an outer peripheral surface of the abutment portion of the needle valve when the abutment portion is seated on the valve seat;

(c) urging means for urging the needle valve toward the valve seat, the needle valve lifting against the bias of the urging means when a fuel pressure received by the pressure receiving portion of the needle valve exceeds a predetermined pressure, so that the abutment portion is brought out of contact with the valve seat, the injection of fuel from the first injection ports being effected preferentially due to a throttle effect between the abutment portion and the valve seat until the amount of lift of the needle valve reaches a specified lift amount, and when the amount of lift of the needle valve exceeds the specified lift amount, the throttling effect being eliminated, so that the injection of the fuel from the second injection ports is effected preferentially; and (d) lift speed limiting means for lowering the speed of lift of the needle valve until the amount of lift of the needle valve reaches the specified lift amount.

DESCRIPTION OF THE PREFERRED EMBODIMENTS

The present invention will now be described with reference to the drawings.

Figure 1:
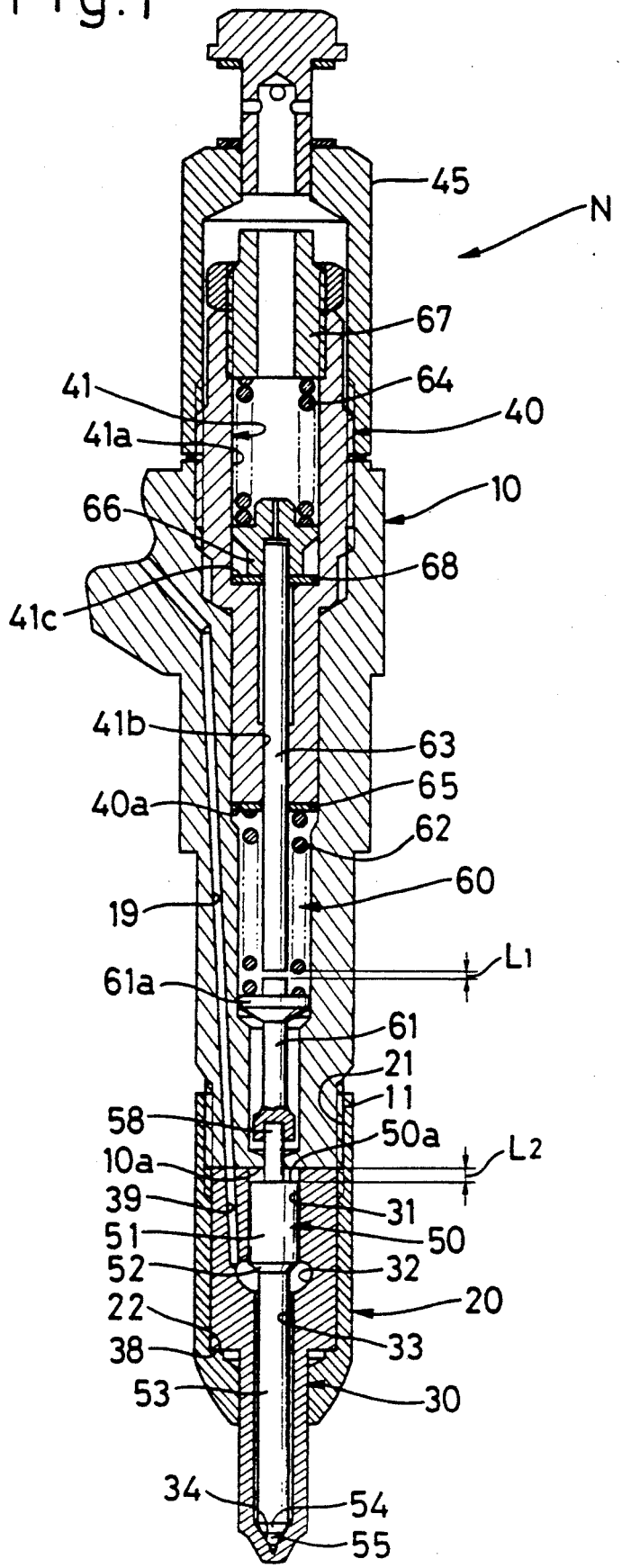
FIG. 1 is a vertical cross-sectional view of a fuel injector according to the present invention.

As shown in FIG. 1, a fuel injector N includes an elongate hollow nozzle holder 10, an elongate nozzle body 30 disposed below the nozzle holder 10, a tubular retainer 20 attaching the nozzle body 30 to the nozzle holder 10, a spring holder 40 threaded into the upper end portion of the nozzle holder 10, and a cap 45 attached to the spring holder 40. These members are arranged coaxially with one another, and jointly provide a single elongate body.

Connection of the nozzle body 30 to the nozzle holder 10 will now be described. An externally-threaded portion 11 is formed on the outer periphery of the lower end portion of the nozzle holder 10. An internally-threaded portion 21 is formed on the inner periphery of the upper end portion of the retainer 20, and a step 22 is formed on the inner periphery of the lower end portion of the retainer 20. A step 38 is formed on the outer periphery of the intermediate portion of the nozzle body 30. The nozzle body 30 is inserted into the retainer 20, and in this condition the internally-threaded portion 21 of the retainer 20 is threadedly engaged with the externally-threaded portion 11 of the nozzle holder 10, so that the nozzle body 30 is connected to the nozzle holder 10 coaxially therewith.

The nozzle body 30 is of an elongate tubular shape, and has a closed lower end. The nozzle body 30 has a guide hole 31, a fuel reservoir chamber 32, a fuel passage hole 33, and a tapered portion 34 which are arranged in this order toward the lower end of the nozzle body 30. The fuel passage hole 33 is smaller in diameter than the guide hole 31, and is coaxially therewith. The fuel reservoir chamber 32 is connected to a fuel inlet (not shown), formed in the upper end surface of the nozzle holder 10, via a fuel passage 19, formed longitudinally in the nozzle holder 10, and a fuel passage 39 formed longitudinally in the nozzle body 30. The above fuel inlet is connected to a fuel injection pump (not shown), for example, of the distribution type via a pipe.

A needle valve 50 is received within the nozzle body 30. The needle valve 50 has a slide portion 51, a pressure receiving portion 52, an extension portion 53, a first tapered portion 54, and a second tapered portion 55 which are arranged in this order toward the lower end of the nozzle body 30 in coaxial relation to one another. The extension portion 53 is smaller in diameter than the slide portion 51, and the pressure receiving portion 52 is tapered. The slide portion 51 is received in the guide hole 31 of the nozzle body 30 so as to slide in its axial direction. The pressure receiving portion 52 is received in the fuel reservoir chamber 32 of the nozzle body 30, and receives a pressure of the fuel reservoir chamber 32. The extension portion 53 is received in the fuel passage hole 33 of the nozzle body 30, and a gap for allowing the flow of the fuel is formed between the outer peripheral surface of the extension portion 53 and the inner peripheral surface of the fuel passage hole 33. The first and second tapered portions 54 and 55 are disposed in opposed relation to the tapered portion 34 of the nozzle body 30.

Figure 2:
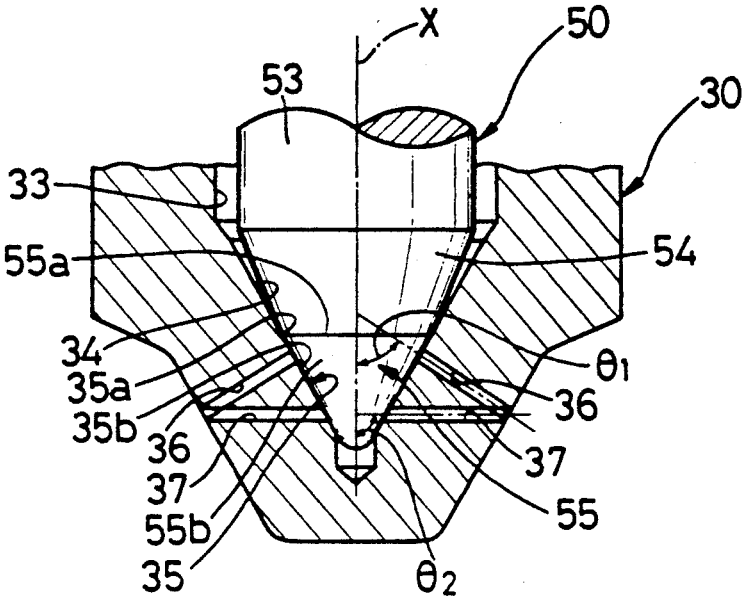
FIG. 2 is an enlarged cross-sectional view of a lower end portion of the fuel injector.

As best shown in FIG. 2, the angle of tapering of the second tapered portion 55 of the needle valve 50 is very slightly larger (for example, about 10 minutes) than, and generally equal to the tapering angle of the tapered portion 34 of the nozzle body 30. Therefore, the second tapered portion 55 can be brought into surface-to-surface contact with the inner peripheral surface of the tapered portion 34 under the influence of a spring 62 (later described) in such a manner that the second tapered portion 55 is slightly deformed resiliently. Hereinafter, the second tapered portion 55 will be referred to as "abutment portion". The tapering angle of the first tapered portion 54 is smaller than the tapering angle of each of the abutment portion 55 and the tapered portion 34 of the nozzle body 30, and therefore the first tapered portion 54 will not be in contact with the inner peripheral surface of the tapered portion 34. That portion of the abutment portion 55 disposed at the boundary between the abutment portion 55 and the first tapered portion 54 is most strongly contacted with the inner peripheral surface of the tapered portion 34, and therefore serves as a main abutment portion **55*a*. That portion lying below the main abutment portion 55*a* serves as a sub-abutment portion 55*b*. That annular portion of the inner peripheral surface of the tapered portion 34 against which the abutment portion 55 is abutted serves as a valve seat 35. That portion of the valve seat 35 against which the main abutment portion 55*a* is abutted serves as a main seat portion 35*a*. That portion of the valve seat 35 against which the subabutment portion 55*b* is abutted serves as a sub-seat portion 35*b***.

Next, a feature of the present invention will be described with reference to FIG. 2. A plurality of (for examples, 5 or 6) pairs of first and second injection ports 36 and 37 are formed in the lower end portion of the nozzle body 30, and are spaced at equal intervals from one another in the circumferential direction. Each pair of first and second injection ports 36 and 37 have generally the same diameter, and are disposed at the same angular position in the direction of the circumference of the nozzle body 30. The angle $\theta_1$ between the axis X of the nozzle body 30 and the first injection port 36 is smaller than the angle $\theta_2$ between the axis X and the second injection port 37. Specifically, in this embodiment, the angle $\theta_1$ is an acute angle (about 60°), and the angle $\theta_2$ is about 90°. The inner ends of the first injection ports 36 and the inner ends of the second injection ports 37 are disposed at the valve seat 35, and are spaced from each other in the direction of the axis of the nozzle body 30. More specifically, the inner end of the first injection port 36 is disposed above the inner end of the second injection port 37. The inner ends of all of the first injection ports 36 are disposed in a common plane perpendicular to the axis of the nozzle body 30, and also the inner ends of all of the second injection ports 37 are disposed in a common plane perpendicular to the axis of the nozzle body 30. Each pair of first and second injection ports 36 and 37 have a substantially common outer end. All of these common outer ends are disposed in a common plane perpendicular to the axis of the nozzle body 30. Incidentally, the first and second injection ports 36 and 37 are omitted from FIG. 1 for the sake of simplicity of the illustration.

In order to achieve unique injection characteristics, the fuel injector N has a lift control mechanism 60 (see FIG. 1) which cooperates with the first and second injection ports 36 and 37. This lift control mechanism 60 is basically similar to that disclosed in Japanese Laid-Open Utility Model Application No. 56-129568, and comprises a first rod 61 received in the nozzle holder 10, a first spring (urging means) 62 received in the nozzle holder 10, a second rod 63 slidably extending through a lower end portion of the spring holder 40, and a second spring (lift speed limiting means) 64 received in the spring holder 40.

A projection 58 is formed on an upper end face **50*a* of the needle valve 50, and extends through a lower end portion of the nozzle holder 10, and the lower end of the first rod 61 is connected to the upper end of the projection 58. A spring seat 61*a* is formed on the outer periphery of that portion of the first rod 61 spaced downward a predetermined distance from the upper end of the rod 61. The lower end of the first spring 62 is abutted against the spring seat 61*a*. The lower end face of the spring holder 40 serves as a spring seat 40*a*, and the upper end of the first spring 62 is abutted against this spring seat 40*a* via a shim 65. The first spring 62 urges the needle valve 50 downward via the first rod 61. The lower limit position of the first rod 61 is determined by the abutment of the abutment portion 55 of the needle valve 50 against the valve seat 35**.

The spring holder 40 has an axially-extending through hole 41, and the second spring 64 is received in a larger-diameter upper portion **41*a* of the through hole 41, and the second rod 63 is slidably received in a smaller-diameter lower portion 41*b* of the through hole 41. A spring seat 66 is fixedly mounted on the upper end portion of the second rod 63, and the lower end of the second spring 64 is abutted against the spring seat 66. A spring seat 67 is threadedly fixed to the upper end portion of the spring holder 40, and the upper end of the second spring 64 is abutted against the spring seat 67. The second rod 63 is urged downward by the resilient force of the second spring 64. The lower limit position of the second rod 63 is determined by the abutment of the spring seat 66 against a shim 68 resting on a step 41***c* formed on the spring holder 40.

The upper end of the first rod 61 in its lower limit position is spaced from the lower end of the second rod 63 in its lower limit position, and this spacing or distance is designated at $L_1$ in FIG. 1. This distance $L_1$ determines a first lift amount of the needle valve 50, as later described. On the other hand, when the needle valve 50 is in its seated condition, the upper end face 50*a* of the needle valve 50 is spaced from a lower end face 10*a* of the nozzle holder 10, and this spacing or distance is designated at $L_2$ in FIG. 1. This distance $L_2$ determines a second lift amount of the needle valve 50, as later described. The distances $L_1$ and $L_2$ are shown in an exaggerated manner in FIG. 1.

Figure 3:
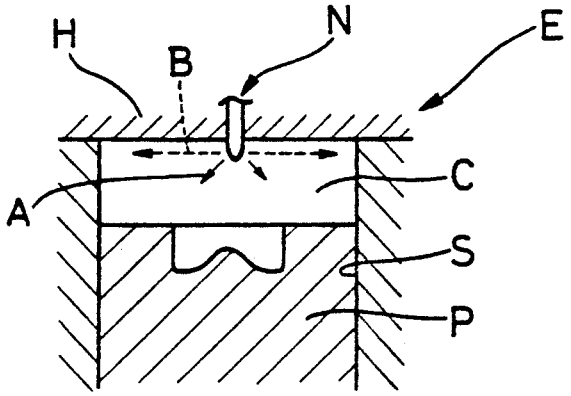
FIG. 3 is a schematic cross-sectional view showing the fuel injector as mounted on an engine.

The fuel injector N of the above construction is mounted on a cylinder head H of an engine E as shown in FIG. 3. In this embodiment, the fuel injector N is mounted in parallel relation to the axes of a cylinder S and a piston P. The front end portion of the fuel injector N is received in a combustion chamber C defined by the cylinder S and the piston P.

Fuel under high pressure is intermittently fed from the fuel injection pump to the fuel injector N of the above construction. When the high-pressure fuel is not supplied to the fuel reservoir chamber 32, the needle valve 50 is urged downward under the influence of the first spring 62, so that the abutment portion 55 of the needle valve 50 is seated on the valve seat 35 in surface-to-surface contacting relation thereto. In this condition, the inner ends of the first and second injection ports 36 and 37 are disposed in contiguous relation to the outer peripheral surface of the abutment portion 55, and therefore are closed by this peripheral surface.

Figure 4:
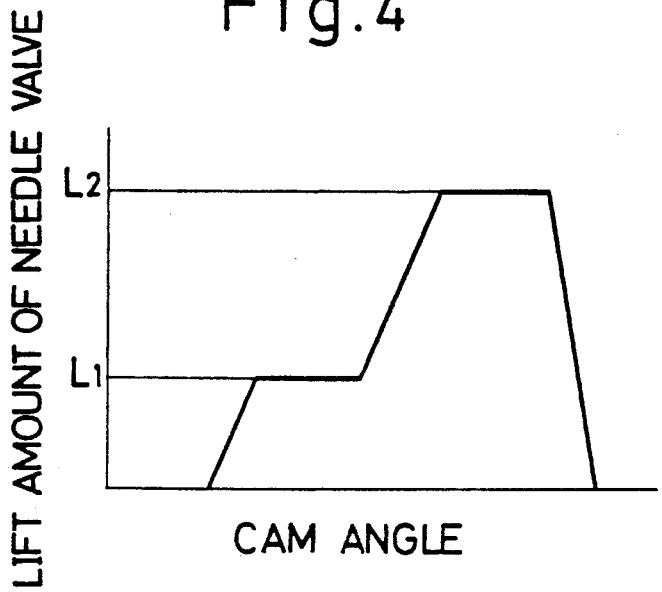
FIG. 4 is a diagram showing the relation between a cam angle and the amount of lift of a needle valve.

The manner of lift of the needle valve 50 when the high-pressure fuel is supplied to the fuel reservoir chamber 32 will now be described with reference to FIG. 4 which shows the relation between the amount of lift of the needle valve 50 and the angle of angular movement of a cam of the distribution-type fuel injection pump used for supplying the high-pressure fuel. This cam angle increases with time.

When the pressure within the fuel reservoir chamber 32, that is, the pressure received by the pressure receiving portion 52 of the needle valve 50, exceeds a predetermined level, the needle valve 50 lifts from the valve seat 35 against the bias of the first spring 62. The needle valve 35 lifts at relatively high speed, and when the amount of this lift reaches the value $L_1$, the upper end of the first rod 61 strikes against the lower end of the second rod 63. As a result, the needle valve 50 receives not only the force of the first spring 62 but also the force of the second spring 64, so that the needle valve 50 is stopped temporarily.

When a large fuel injection amount is required because of a high engine load, the supply of the high-pressure fuel to the fuel reservoir chamber 32 is continued, and besides the amount of feed of the fuel per unit time is increased. As a result, the pressure within the fuel reservoir chamber 32 further increases to reach another predetermined level, so that the upward force received by the pressure receiving portion 52 of the needle valve 50 exceeds the combined forces of the first and second springs 62 and 64, and therefore the needle valve 50 again begins to rise. Then, when the amount of lift of the needle valve 50 reaches the value $L_2$, the upper end face 50*a* of the needle valve 50 is abutted against the lower end face 10*a* of the nozzle holder 10, so that the needle valve 50 is stopped temporarily. When one shot of the high-pressure fuel feed to the fuel reservoir chamber 32 is finished, the pressure within the fuel reservoir chamber 32 suddenly drops, so that the needle valve 50 is caused to be seated on the valve seat 35 by the forces of the first and second springs 62 and 64.

The fuel injection is effected in the following manner when the needle valve 50 lifts. At the initial stage of lift of the needle valve 50 at which the amount of lift is small, the clearance between the outer peripheral surface of the abutment portion 55 and the inner peripheral surface of the valve seat 35 is small, and therefore the fuel, fed from the fuel reservoir chamber 32 via the fuel passage hole 33, resides in this clearance, and is injected preferentially from the first injection ports 36. In other words, because of a pressure loss due to the throttling effect at this clearance, the pressure of the inner ends of the first injection ports 36 is higher than the pressure of the inner ends of the second injection ports 37, and therefore the first injection ports 36 are selected for fuel injection, and the fuel injection from the second injection ports 37 is not effected. Therefore, the fuel is injected obliquely downward from the lower end portion of the fuel injector N into the combustion chamber C, as indicated by arrow A in FIG. 3. Since the fuel is then injected obliquely downward, the injected fuel can be directed to the vicinity of the central portion of the combustion chamber.

When the lift amount of the needle valve 50 increases and exceeds a specified lift amount, the above clearance increases to lose the throttling effect. As a result, the fuel passes through this clearance, and tends to reside at the lower end portion of the nozzle body 30. At this time, because of a Venturi effect due to the passage of the fuel through this clearance, the pressure of the inner ends of the first injection ports 36 becomes lower than the pressure of the inner ends of the second injection ports 37. As a result, the fuel injection is switched to the second injection ports 37, and the fuel is injected generally laterally from the lower end portion of the nozzle body 30 as indicated by arrow B in FIG. 3.

As described above, first, the fuel is injected obliquely downward, and then the fuel is injected generally laterally, and therefore the fuel can be distributed into the combustion chamber C over a wide area. This enhances the combustion efficiency.

The first lift amount $L_1$ is smaller than the above specified lift amount, and therefore when the needle valve 50 is kept stopped with the first lift amount $L_1$, the throttle effect due to the clearance between the abutment portion 55 of the needle valve 50 and the valve seat 35 is effective to maintain the fuel injection from the first injection ports 36. Without the second spring 64, the fuel injection from the first injection ports 36 would be effected only for a very short time period; however, with the use of the second spring 64 as in the present invention, the needle valve 50 is stopped with the first lift amount $L_1$, so that the fuel can be injected from the first injection ports 36 for a sufficient time period, thereby distributing the fuel into the engine cylinder over a wide area.

The second lift amount $L_2$ is larger than the above specified lift amount, and therefore when the needle valve 50 is kept stopped with the second lift amount $L_2$, the fuel is injected from the second injection ports 37.

Further, due to the pressure difference between the inner ends of the first injection ports 36 and the inner ends of the second injection ports 37, a pressure difference between those portions of the first and second injection ports 36 and 37 near their common outer end also develops. Due to this pressure difference, a cavitation develops in the fuel at the common outer end. This cavitation is rapidly expanded when the fuel is injected into the combustion chamber C from the common outer end, thereby efficiently making the fuel particles fine. As a result, the vaporization of the fuel is promoted, and the combustion efficiency is enhanced.

Other embodiments of the present invention will now be described. Those portions of these embodiments corresponding to those of the preceding embodiment are designated by identical reference numerals, respectively, and detailed explanation thereof will be omitted.

Figure 5:
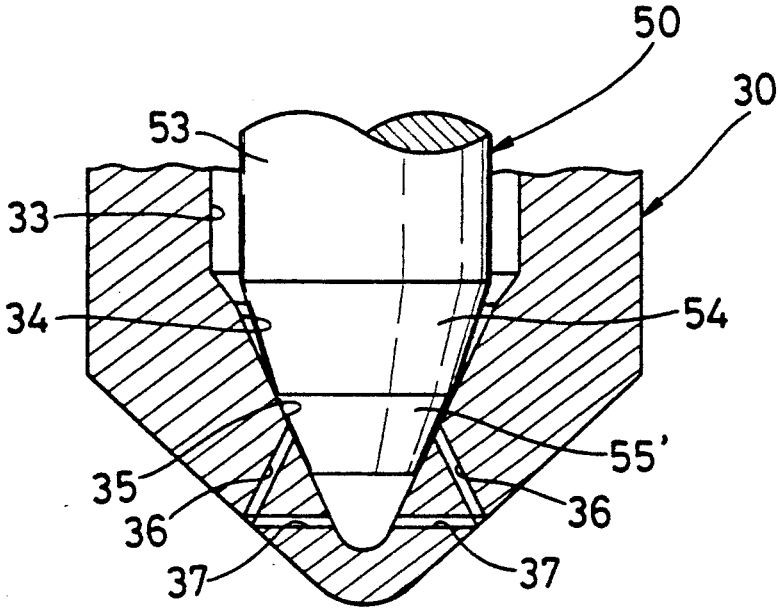
FIG. 5 is a view similar to FIG. 2, but showing a modified needle valve.

In the embodiment shown in FIG. 5, a front end portion of a nozzle body 30 has a tapered portion 34 part of which serves as a valve seat 35, first injection ports 36, and second injection ports 37. On the other hand, a front end portion of a needle valve 50 has a first tapered portion 54 and a second tapered portion (abutment portion) 55'. The relation of the tapering angle between the first tapered portion 54, the abutment portion 55' and the valve seat 35 is the same as described in the preceding embodiment. In this embodiment, the front end of the abutment portion 55' is cut off. The inner ends of the first injection ports 36 are disposed at the valve seat 35, and are closed by the outer peripheral surface of the abutment portion 55' when the needle valve 50 is in its seated condition. The inner ends of the second injection ports 37 are open to the lower portion of the inner surface of the tapered portion 34, and are spaced downward from the valve seat 35. When the needle valve 50 is in its seated condition, the second injection ports 37 are not closed by the outer peripheral surface of the abutment portion 55'.

Figure 6:
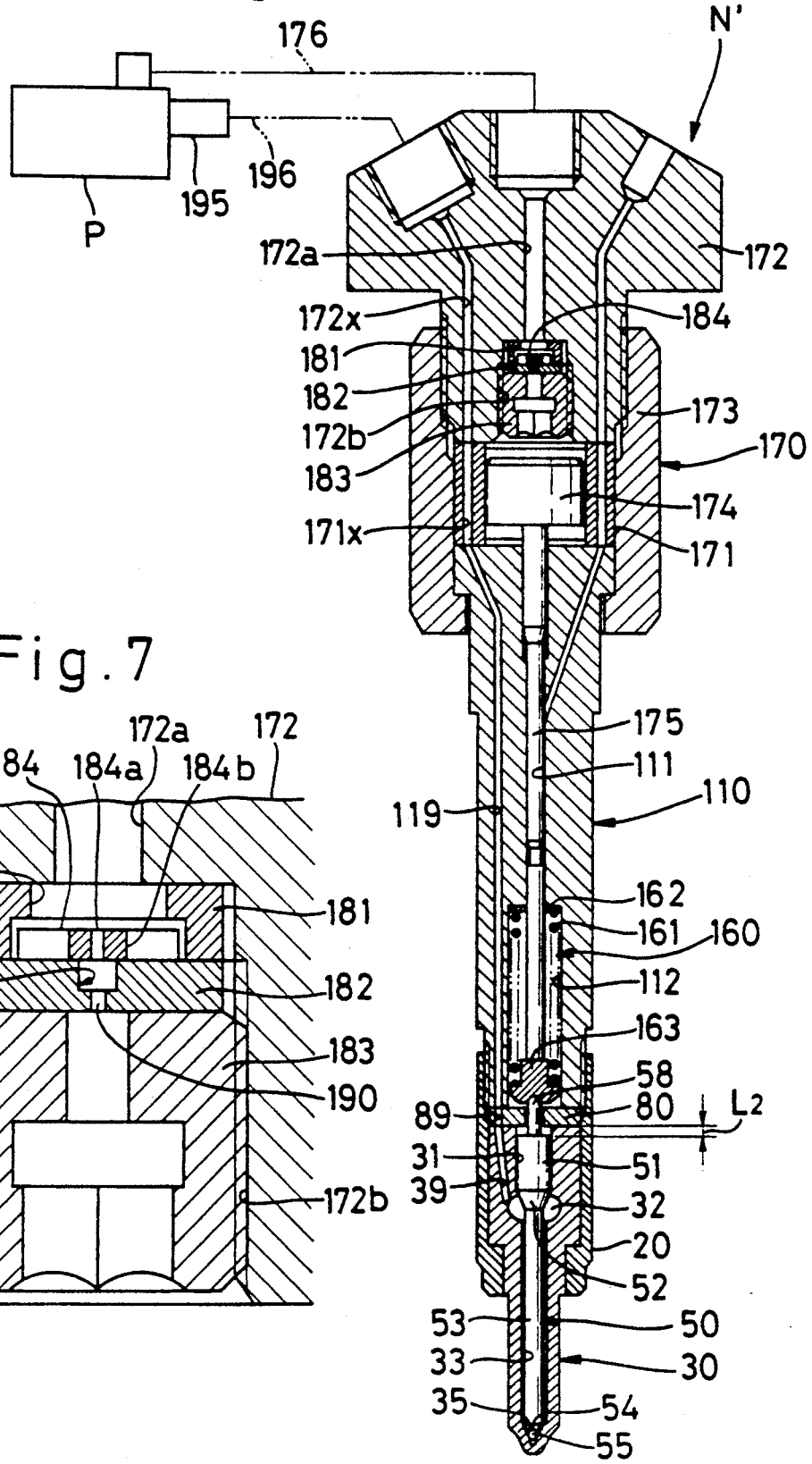
FIG. 6 is a view similar to FIG. 1, but showing a modified fuel injector.

A lift control mechanism 160 of a fuel injector N' shown in FIG. 6 differs greatly from the lift control mechanism 60 of the fuel injector N of FIG. 1. The lift control mechanism 160 is basically similar to that disclosed in Japanese Laid-Open Utility Model Application No. 1-158553. A nozzle body 30, a retainer 20 and a needle valve 50 are identical respectively to those of the fuel injector N of FIG. 1.

In the fuel injector N', the nozzle body 30 is connected to a lower end of a nozzle holder 110 by the retainer 20 via a spacer 80. The spacer 80 has a fuel passage 89 which connects an upper end of a fuel passage 39 of the nozzle body 30 to a lower end of a fuel passage 119 of the nozzle holder 110. The nozzle holder 110 has a guide hole 111 extending downwardly from the upper end thereof, and a receiving hole 112 extending from the guide hole 111 in coaxial relation thereto, the receiving hole 112 being open to the lower end face of the nozzle holder 110.

The lift control mechanism of the fuel injector N' includes a spring 161, and a hydraulic urging mechanism 170. The spring 161 and the hydraulic urging mechanism 170 cooperate with each other to provide urging means for urging the needle valve 50 toward a valve seat 35. The spring 161 is received in the receiving hole 112 in the nozzle holder 110, and the upper end of the spring 161 is held against the upper end of the receiving hole 112 via a shim 162, and the lower end of the spring 161 is held against a spring seat 163. The spring seat 163 is held against a projection 58 extending from the upper end of the needle valve 50.

The hydraulic urging mechanism 170 comprises a cylinder 171 of a short cylindrical shape resting on the upper end face of the nozzle holder 110, a head member 172 placed on the upper end of the cylinder 171, a retainer 173 which receives the cylinder 171 therein and connects the cylinder 171 and the head member 172 to the nozzle holder 110, and a piston 174 received in the cylinder 171. The piston 174 receives a low fuel pressure at its upper end face, as later described. The pressure-receiving area of the piston 174 is larger than a pressure-receiving area of a pressure receiving portion 52 of the needle valve 50. An upper end of a rod 175 slidably received in the guide hole 111 in the nozzle holder 110 is abutted against the lower end face of the piston 174. The lower end of the rod 175 is abutted against the spring seat 163. Therefore, the force due to the low fuel pressure received by the piston 174 acts on the needle valve 50 via the rod 175 and the spring seat 163.

The head member 172 has a pressure introduction passage **172*a*, and a receiving hole 172*b* which is communicated with the pressure introduction passage 172*a* and is open to the lower end face of the head member 172. A cam chamber (not shown) of a distribution-type fuel injection pump P is connected to the pressure introduction passage 172*a* via a conduit 176 so that the fuel pressure proportional to the engine speed can be introduced into the pressure introduction passage 172*a*. Therefore, the cam chamber of the fuel injection pump P serves as pressure supply means. This fuel pressure applied to the piston 174 is far lower than the pressure of the fuel injected into an engine combustion chamber via a delivery valve 195 of the fuel injection pump P and a fuel reservoir chamber 32**.

Figure 7:
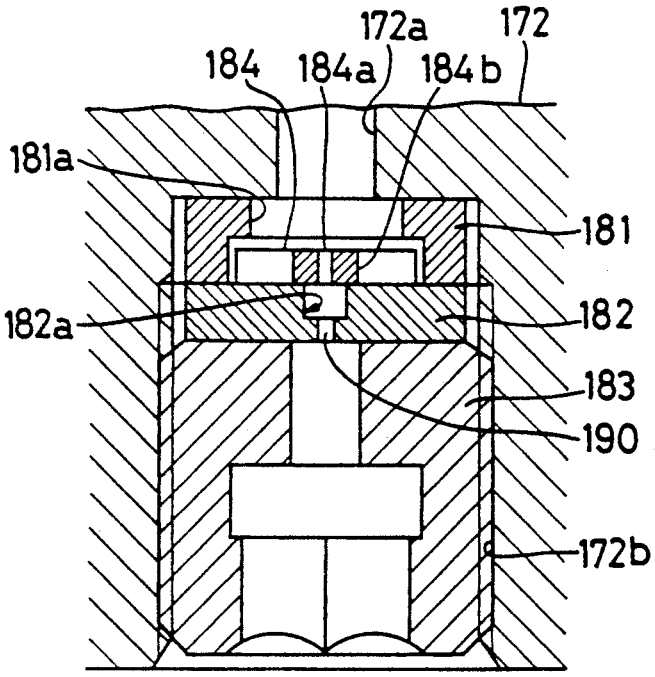
FIG. 7 is an enlarged cross-sectional view of an important portion of the fuel injector of FIG. 6.

As best shown in FIG. 7, a valve holder 181 of a cylindrical shape and a disk-shaped valve seat 182 are received in the receiving hole **172*b* of the head member 172, and are arranged in this order from the upper side. The valve holder 181 and the valve seat 182 are fixed by a tubular holder member 183 threaded into the receiving hole 172*b*. A stepped hole 182*a* is formed through a central portion of the valve seat 182, and a smaller-diameter lower portion of the stepped hole 182*a* serves as an orifice 190. A flat valve 184 for closing a larger-diameter upper portion of the stepped hole 182*a* is placed on the valve seat 182. The flat valve 184 has a central orifice 184*a* smaller in diameter than the orifice 190 in the valve seat 182, and this arrangement absorbs the pulsation of the pressure of the cam chamber of the fuel injection pump. The valve seat 184 is movable upward and downward between the valve seat 182 and a flange 181*a* formed on the upper end of the valve holder 181. Notches 184*b* are formed in the outer peripheral portion of the flat valve 184. When the pressure within the cylinder 171 increases to lift the flat valve 184, the fuel in the cylinder 171 passes through the notches 184*b* to return to the fuel injection pump P. Therefore, the flat valve 184 does not make any contribution to the lift characteristics of the needle valve 50. For the sake of simplicity of the illustration, the orifices 190 and 184*a* are omitted from FIG. 6**.

The high-pressure fuel discharged from the delivery valve 195 of the fuel injection pump P passes through a conduit 196, fuel passages 172*x* and 171*x* formed respectively in the head member 172 and the cylinder 171, and further flows into the fuel reservoir chamber 32 through fuel passages 119, 89 and 39.

In the fuel injector N' of the above construction, the needle valve 50 is kept seated on the valve seat 35 by the force of the spring 161 and the hydraulic pressure received by the piston 174. When the high-pressure fuel discharged from the distribution-type fuel injection pump P reaches the fuel reservoir chamber 32 to increase the pressure of this chamber 32 to a predetermined level, the needle valve 50 lifts against the above spring force and hydraulic force.

The needle valve 50, when lifted, urges the piston 174 upward via the rod 175. As a result, the pressure within the cylinder 171 increases, so that the fuel in the cylinder 171 returns toward the cam chamber of the fuel injection pump P via the orifice 190. At this time, the speed of lift of the needle valve 50 is made lower by the resistance to the flow of the fuel through the orifice 190. The amount of lift of the needle valve 50 at this time is smaller than the above specified lift amount, and is in such a lift region that the fuel is injected preferentially from the first injection ports 36 (see FIG. 2) due to the throttling effect produced between the abutment portion 55 of the needle valve 50 and the valve seat 35. Therefore, the time period of the fuel injection from the first injection ports 36 can be prolonged.

The amount of feed of the fuel from the fuel injection pump P per unit time increases abruptly with the increase of the cam angle. At this time, the pressure within the cylinder 171 increases abruptly, so that the amount of flow of the fuel through the orifice 190 increases, thereby increasing the speed of lift of the needle valve 50. When the lift amount of the needle valve 50 exceeds the above specified lift amount, the injection of the fuel from the second injection ports 37 (see FIG. 2) begin. Then, when the needle valve 50 further lifts to reach the lift amount $L_2$, the upper end face of the needle valve 50 is abutted against the lower end face of the spacer 80, so that the needle valve 50 is stopped temporarily, thereby maintaining the injection of the fuel from the second injection ports 37. Then, when one shot of the fuel feed from the fuel injection pump P is finished, the needle valve descends to be seated on the valve seat 35.

Figure 8:
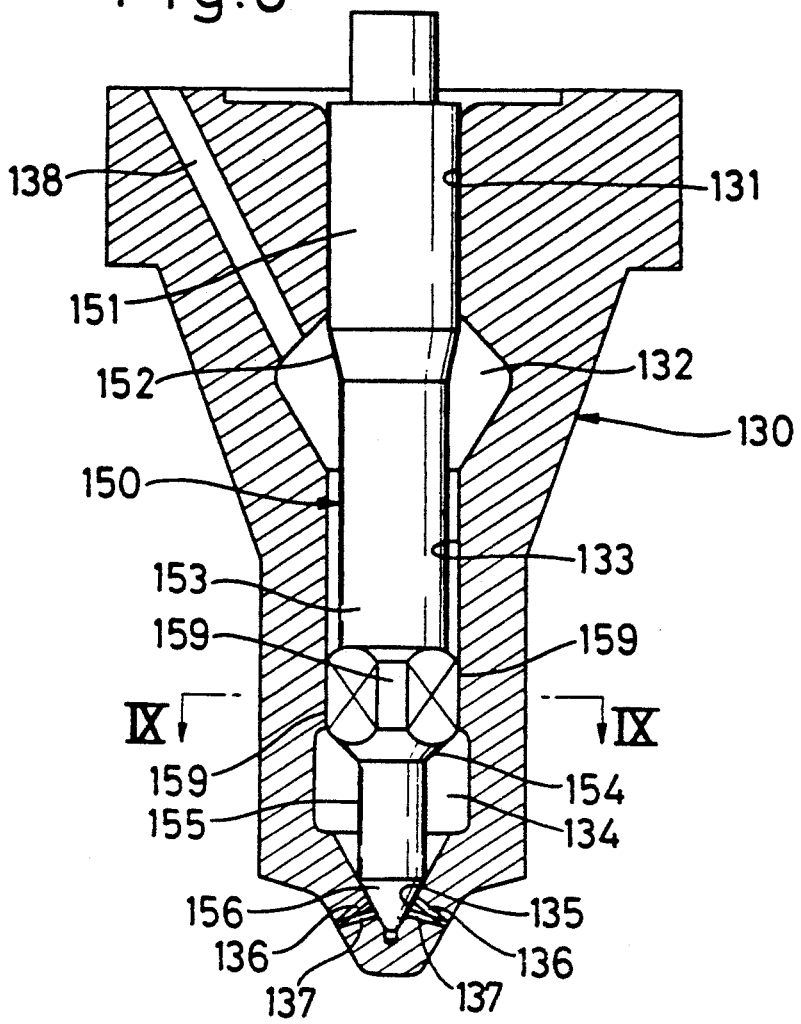
FIG. 8 is an enlarged cross-sectional view of another embodiment with a guide means, showing a nozzle body and a needle valve.
Figure 9:
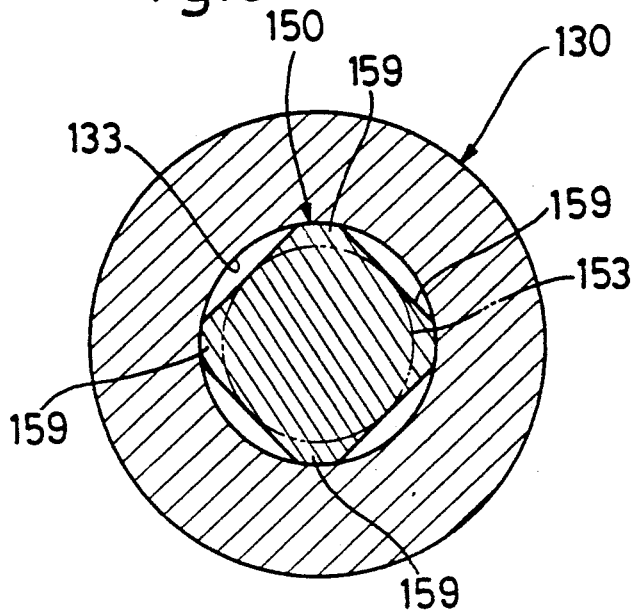
FIG. 9 is a cross-sectional view taken along the line XI—XI of FIG. 8.

The nozzle body 30 and the needle valve 50 in the embodiments of FIGS. 1 and 6 may be replaced respectively by a nozzle body 130 and a needle valve 150 shown in FIGS. 8 and 9. The nozzle body 130 includes a guide hole 131, a first fuel reservoir chamber 132, a fuel passage hole 133, a second fuel reservoir chamber 134, a valve seat 135, first injection ports 136, second injection ports 137, and a fuel passage 138 communicated with the first fuel reservoir chamber 132. The needle valve 150 includes a slide portion 151 received in the guide hole 131, a first pressure receiving portion 152 received in the first fuel reservoir chamber 132, a first extension portion 153 received in the fuel passage hole 133, a second pressure receiving portion 154 received in the second fuel reservoir chamber 134, a second extension portion 155 received in the second fuel reservoir chamber 134, and an abutment portion 156 for abutting against the valve seat 135. Four projections (guide means) 159 are formed on and extend radially outwardly from the outer periphery of the lower end portion of the first extension portion 153. The distal end surface of each of the projections 159 has an arcuate shape, and is in contact with the inner peripheral surface of the fuel passage hole 133 of the nozzle body 130.

In this embodiment shown in FIGS. 8 and 9, the radial (lateral) shaking of the needle valve 150 which would occur due to a small clearance between the inner peripheral surface of the guide hole 131 of the nozzle body 130 and the slide portion 151 of the needle valve 150 is prevented by the contact of the distal end surfaces of the projections 159 with the inner peripheral surface of the fuel passage hole 133. With this arrangement, when the needle valve 150 lifts, the clearance between the abutment portion 156 of the needle valve 150 and the valve seat 135 can be kept uniform over the entire circumference of the abutment portion 156, and therefore the switching of the fuel injection from the first injection ports 136 to the second injection ports 137 can be effected at the same time with respect to all pairs of first and second injection ports 136 and 137. And besides, the amount of the fuel injection does not become irregular in the circumferential direction. Further, variations or irregularities in the fuel injection which would occur each time the needle valve 150 lifts can be prevented. The second fuel reservoir chamber 134 also serves to eliminate a pressure imbalance with respect to the fuel passing through the spaces between the adjacent projections 159.

Figure 10:
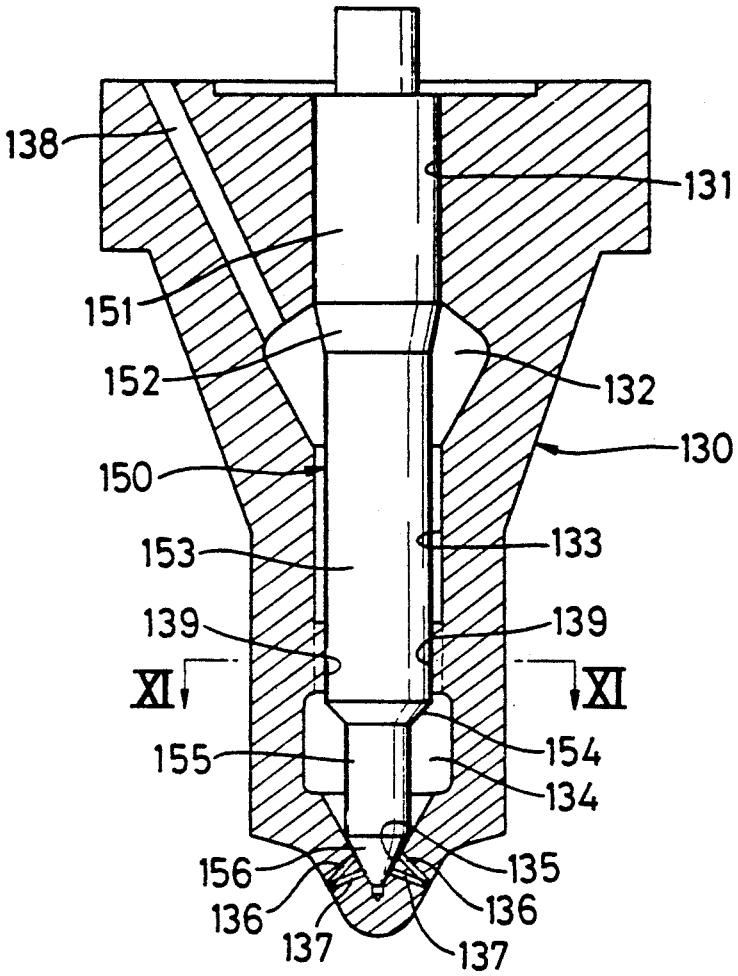
FIG. 10 is a view similar to FIG. 8, but showing a further embodiment with a guide means.
Figure 11:
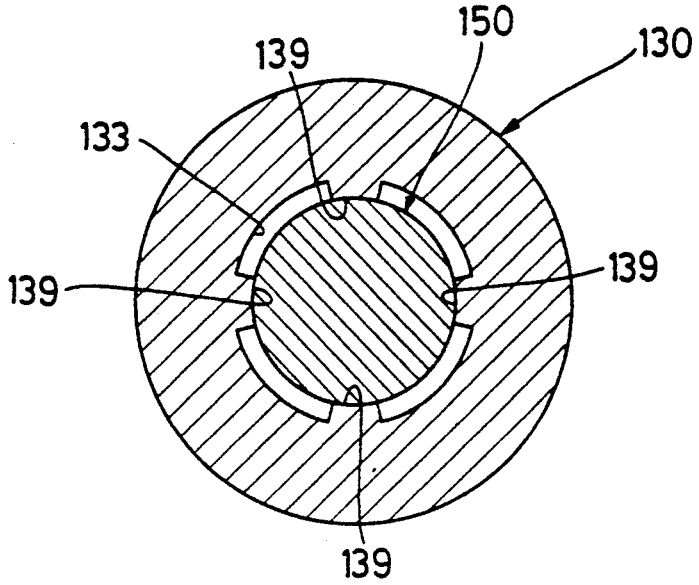
FIG. 11 is a cross-sectional view taken along the line XI—XI of FIG. 10.

In an embodiment shown in FIGS. 10 and 11, a plurality of projections (guide means) 139 are formed on and extend radially inwardly from an inner peripheral surface of a fuel passage hole 133. The lateral shaking of a needle valve 150 is prevented by the contact of the distal end surfaces of the projections 139 with an outer peripheral surface of a first extension portion 153 of the needle valve 150.

The present invention is not limited to the above embodiments, and various modifications can be made. For example, in FIG. 2, the tapering angle of the abutment portion 55 of the needle valve 50 may be slightly larger than the tapering angle of the valve seat 35. In this case, only the main abutment portion 55*a* can be disposed in line contact with the main seat portion 35*a* of the valve seat 35. The sub-seat portion 35*b* of the valve seat 35 is spaced very slightly from the sub-abutment portion 55*b* of the abutment portion 55. The inner ends of the first injection ports 36 are disposed at the sub-seat portion 55*b*, and are not completely closed by the outer peripheral surface of the abutment portion 55 of the needle valve 50.

When the fuel injector is mounted on the engine in inclined relation to the axis of the engine cylinder, the inclination angles of the first injection ports, as well as the inclination angles of the second injection ports, are different from one another. In this case, the angles of one pair of first and second injection ports relative to the axis of the nozzle body are the largest of those of all pairs of first and second injection ports, and the angles of that pair of first and second injection ports disposed in diametrically opposite relation to the above one pair of first and second injection ports are the smallest. In this case, the inner ends of all of the first injection ports are disposed in a common plane perpendicular to the axis of the nozzle body, and the inner ends of all of the second injection ports are also disposed in a common plane perpendicular to the axis of the nozzle body.

The plurality of pairs of first and second injection ports may be arranged circumferentially at unequal intervals. The diameter of the first injection port may be different from that of the second injection port.

What is claimed is:

1. A fuel injector comprising:

(a) a hollow elongate nozzle body having a closed distal end portion, said nozzle body having a guide hole, a fuel reservoir chamber provided forwardly of said guide hole, a tapered valve seat formed on an inner surface of the distal end portion of said nozzle body, and a plurality of pairs of first and second injection ports formed in the distal end portion of said nozzle body and spaced from one another in a direction of the periphery of said nozzle body, the angle of said first injection port relative to an axis of said nozzle body being different from the angle of said second injection port relative to the axis of said nozzle body, inner ends of said first injection ports being disposed at said valve seat, inner ends of said second injection ports being spaced from the inner ends of said first injection ports toward the distal end of said nozzle body in the direction of the axis of said nozzle body, and each pair of said first and second injection ports having a common outer end;

(b) a needle valve received in said nozzle body, said needle valve having a slide portion slidably received in said guide hole, a pressure receiving portion received in said fuel reservoir chamber, and a tapered conical abutment portion formed at a distal end portion of said needle valve, and the inner ends of said first injection ports facing and sealed by an outer peripheral surface of said abutment portion of said needle valve when said abutment portion is seated on said valve seat;

(c) urging means for urging said needle valve toward said valve seat, said needle valve lifting against the bias of said urging means when a fuel pressure received by said pressure receiving portion of said needle valve exceeds a predetermined pressure, so that said abutment portion is brought out of contact with said valve seat, the injection of fuel from said first injection ports being effected due to a throttle effect between said abutment portion and said valve seat until the amount of lift of said needle valve reaches a specified lift amount, and when the amount of lift of said needle valve exceeds said specified lift amount, said throttling effect being eliminated, so that the injection of the fuel from said second injection ports is effected; and (d) lift speed limiting means for lowering the speed of lift of said needle valve until the amount of lift of said needle valve reaches said specified lift amount.

2. A fuel injector according to claim 1, in which said lift speed limiting means substantially stops said needle valve temporarily, so that the amount of lift of said needle valve is maintained at a predetermined lift amount smaller than said specified lift amount.

3. A fuel injector according to claim 2, in which said urging means comprises a first spring, and said lift speed limiting means comprises a second spring, said first spring urging said needle valve toward said valve seat via a first rod, said second spring urging a second rod disposed coaxially with said first rod, and when said first rod and said second rod are at their respective limit positions close to said valve seat, said first rod and said second rod being spaced from each other by a distance corresponding to said predetermined lift amount.

4. A fuel injector according to claim 1, in which said lift speed limiting means lowers the speed of lift of said needle valve, utilizing a resistance to the flow of a fluid.

5. A fuel injector according to claim 4, in which said urging means comprises a spring and a hydraulic urging mechanism which urge said needle valve toward said valve seat, said hydraulic urging mechanism comprising a cylinder, a piston which is received in said cylinder and has a pressure receiving area larger than that of said pressure receiving portion of said needle valve, and pressure supply means for supplying to said piston a pressure far lower than said fuel pressure, said piston being operatively connected to said needle valve via a rod, and said lift speed limiting means having an orifice provided between said cylinder and said pressure supply means.

6. A fuel injector according to claim 1, in which said nozzle body has a fuel passage hole provided between said fuel reservoir chamber and said valve seat, said needle valve having an extension portion which is provided between said pressure receiving portion and said abutment portion and is received in said fuel passage hole, and guide means for preventing said needle valve from being shaken in directions perpendicular to the axis of said needle valve being provided between an outer peripheral surface of said extension portion and an inner peripheral surface of said fuel passage hole.

7. A fuel injector according to claim 6, in which said guide means comprises a plurality of projections extending radially outwardly from the outer peripheral surface of said extension portion of said needle valve, distal end surfaces of said plurality of projections being in contact with the inner peripheral surface of said fuel passage hole in said nozzle body.

8. A fuel injector according to claim 6, in which said guide means comprises a plurality of projections extending radially inwardly from the inner peripheral surface of said fuel passage hole in said nozzle body, distal end surfaces of said plurality of projections being in contact with the outer peripheral surface of said extension portion of said needle valve.

9. A fuel injector according to claim 1, in which the angle of tapering of said valve seat is substantially the same as the angle of tapering of said abutment portion of said needle valve, whereby when said needle valve is seated on said valve seat, the inner ends of said first injection ports are closed by the outer peripheral surface of said abutment portion.

10. A fuel injector according to claim 1, in which the inner ends of said second injection ports are disposed at said valve seat, whereby when said abutment portion of said needle valve is seated on said valve seat, the inner ends of said second injection ports face the outer peripheral surface of said abutment portion.

11. A fuel injector according to claim 1, in which when said abutment portion of said needle valve is seated on said valve seat, the inner ends of said second injection ports are spaced from a distal end of said abutment portion in a direction of the axis of said needle valve.

* * * * *